US012781759B2

(12) United States Patent
Shen

(10) Patent No.: US 12,781,759 B2
(45) Date of Patent: Nov. 3, 2026

(54) FAN BLADE DESIGN FOR COOLING FANS

(71) Applicant: COOLER MASTER CO., LTD., Taipei City (TW)

(72) Inventor: Jia-Hong Shen, Taipei City (TW)

(73) Assignee: COOLER MASTER CO., LTD., Taipei City (TW)

( * ) Notice: Subject to any disclaimer, the term of this patent is extended or adjusted under 35 U.S.C. 154(b) by 0 days.

(21) Appl. No.: 19/223,654

(22) Filed: May 30, 2025

(65) Prior Publication Data

US 2025/0369451 A1 Dec. 4, 2025

(30) Foreign Application Priority Data

May 31, 2024 (TW) ..... 113205637

(51) Int. Cl.

| | |
|---|---|
| ***F04D 29/38*** | (2006.01) |
| ***F04D 25/08*** | (2006.01) |
| ***F04D 29/30*** | (2006.01) |
| ***F04D 29/32*** | (2006.01) |
| ***F04D 29/66*** | (2006.01) |

(52) U.S. Cl.

CPC ..... *F04D 29/386* (2013.01); *F04D 25/08* (2013.01); *F04D 29/325* (2013.01); *F04D 29/666* (2013.01)

(58) Field of Classification Search

CPC ..... F04D 25/08; F04D 29/30; F04D 29/38; F04D 29/384; F04D 29/386; F04D 29/325; F04D 29/388; F04D 29/681; F04D 19/002; F04D 29/329; F04D 29/164; F04D 29/181; F04D 29/666; F04D 19/00; F04D 29/242; F04D 29/263; F04D 29/281; F04D 29/282; F04D 29/663; F05D 2240/303; F05D 2240/304; F05D 2240/307; F05D 2250/712; F01D 5/141; F03B 3/121; F03B 3/12; F05B 2240/303

See application file for complete search history.

(56) References Cited

U.S. PATENT DOCUMENTS 2,684,723 A * 7/1954 Faber ..... F04D 29/547 416/228
5,064,345 A * 11/1991 Kimball ..... F04D 29/326 416/169 A (Continued)

FOREIGN PATENT DOCUMENTS

| | | |
|---|---|---|
| CN | 204186638 U | 3/2015 |
| CN | 210484185 U | 5/2020 |

OTHER PUBLICATIONS

Machine Translation of CN204186638 U [retrieved on Mar. 31, 2026]. Retrieved from: Espacenet. (Year: 2026).*

(Continued)

*Primary Examiner* — Eric J Zamora Alvarez
(74) *Attorney, Agent, or Firm* — Merchant & Gould P.C.

(57) ABSTRACT

A fan blade design includes a hub and a plurality of blades connected to the hub. Each of the blades is a swept-back blade and has a leading edge and a trailing edge disposed opposite the leading edge. The trailing edge includes a first concave arc segment and a second concave arc segment, the first concave arc segment being positioned closer to the hub than the second concave arc segment. A chord length of the first concave arc segment is greater than a chord length of the second concave arc segment.

20 Claims, 3 Drawing Sheets

(56) References Cited

U.S. PATENT DOCUMENTS

| | | | | |
|---|---|---|---|---|
| 7,044,712 | B2 * | 5/2006 | Cho | F04D 29/384 416/169 A |
| 10,288,036 | B2 * | 5/2019 | Liu | F03B 3/12 |
| 10,508,662 | B2 * | 12/2019 | Nakashima | F04D 29/384 |
| 11,067,093 | B2 * | 7/2021 | Tadokoro | F04D 29/384 |
| 2007/0243064 | A1 * | 10/2007 | Nakano | F04D 29/384 416/63 |
| 2020/0018323 | A1 * | 1/2020 | Cao | F04D 29/326 |
| 2022/0221214 | A1 * | 7/2022 | Tadokoro | F25D 17/067 |

OTHER PUBLICATIONS

Machine Translation of CN210484185 U [retrieved on Mar. 31, 2026]. Retrieved from: Espacenet. (Year: 2026).*

* cited by examiner

FAN BLADE DESIGN FOR COOLING FANS

CROSS-REFERENCE AND RELATED APPLICATIONS

This U.S. application claims priority to Taiwan application No. 113205637, filed on May 31, 2024, which is incorporated herein by reference in its entirety.

TECHNICAL FIELD

The present disclosure relates to cooling devices, and more particularly to a fan blade design for use in cooling fans, such as those employed in electronic devices.

BACKGROUND

Electronic devices generate heat during operation, and effective thermal management is critical for maintaining performance and reliability. A commonly adopted solution is using fans to induce airflow that dissipates heat from heat-generating components.

As electronic devices advance in performance and processing power, the heat generated has correspondingly risen. In response to the increasing cooling demand, greater fan speeds are frequently necessary. However, increased fan speed generally leads to greater noise levels, which can negatively affect user experience-especially in settings where quiet operation is preferred, such as in personal computers, servers, and consumer electronics.

Accordingly, there is a constant demand in the field for enhanced fan blade designs that can sustain or enhance cooling performance while minimizing acoustic noise generated during operation.

SUMMARY

In general terms, this disclosure is directed to a fan blade design for cooling fans. In some embodiments, and by non-limiting example, the present disclosure provides a newly developed fan blade design that enhances heat dissipation efficiency while minimizing acoustic noise generated during operation.

An aspect of the present disclosure provides a fan blade design. The fan blade design includes a hub, and a plurality of blades connected to the hub, wherein each of the blades is a swept-back blade and has a leading edge and a trailing edge disposed opposite the leading edge, the trailing edge includes a first concave arc segment and a second concave arc segment, the first concave arc segment being positioned closer to the hub than the second concave arc segment, and a chord length of the first concave arc segment is greater than a chord length of the second concave arc segment.

In one embodiment, the first concave arc segment is seamlessly connected to second concave arc segment.

In one embodiment, a ratio of a chord length of the first concave arc segment to a chord length of the second concave arc segment is at least 1.1.

In one embodiment, the trailing edge further comprises a straight segment that is located between the hub and the first concave arc segment.

In one embodiment, the first concave arc segment is connected to the hub via the straight segment.

In one embodiment, the hub has a top surface, and the leading edge of each blade is arranged closer to the top surface of the hub than the trailing edge of the blade.

In one embodiment, the leading edge of each blade includes a third concave arc segment, and a chord length of the third concave arc segment is greater than a combined chord lengths of the first and second concave arc segment.

In one embodiment, the hub includes a top surface and an outer peripheral surface, the outer peripheral surface is connected to a periphery of the top surface, and the blades are connected to the outer peripheral surface of the hub.

In one embodiment, each blade extends radially outward and declines from leading edge to trailing edge.

In one embodiment, the blade has a tip and a root, the tip is positioned rearward relative to the root, and a sweepback angle between the tip and the root from the center of the hub is greater than 19 degrees.

Another aspect of the present disclosure provides a cooling fan. The cooling fan includes a fan blade design that has a hub, and a plurality of blades connected to the hub, wherein each of the blades is a swept-back blade and has a leading edge and a trailing edge disposed opposite the leading edge, the trailing edge includes a first concave arc segment and a second concave arc segment, the first concave arc segment being positioned closer to the hub than the second concave arc segment, and a chord length of the first concave arc segment is greater than a chord length of the second concave arc segment, and a motor that is disposed inside the hub and is configured to drive the rotation of the hub and the blades.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

Figure 1:
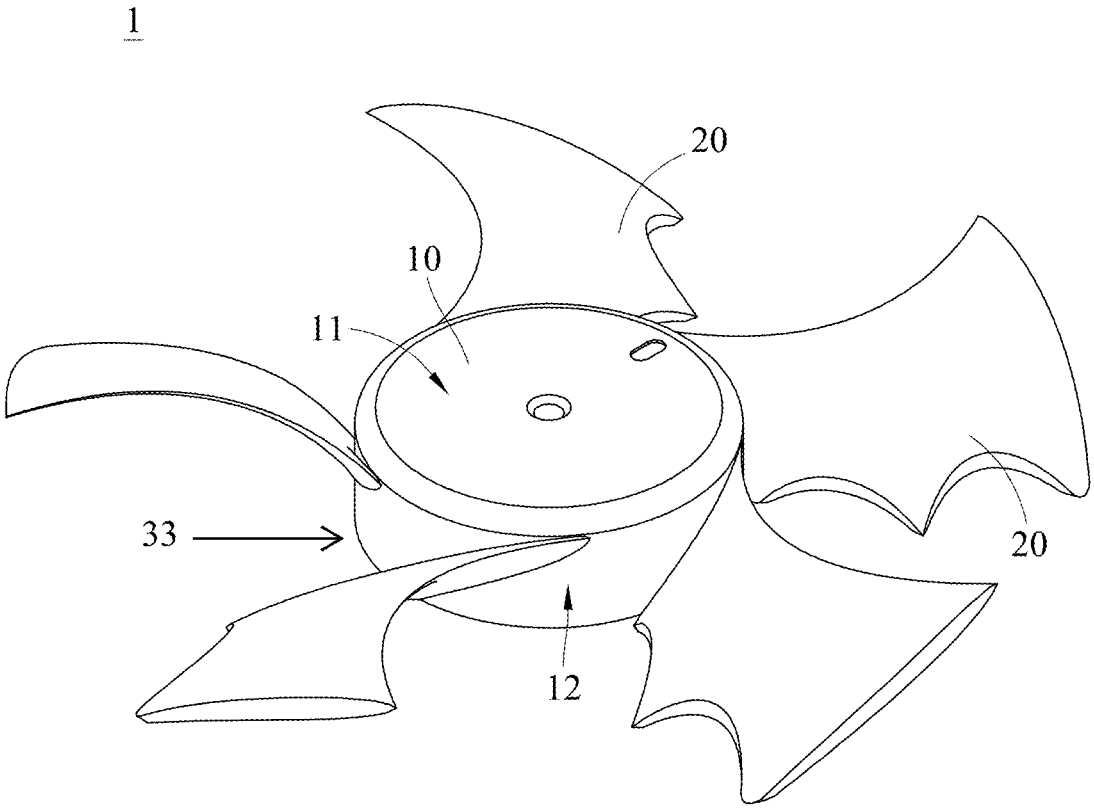
FIG. 1 is a perspective view of a fan blade design in accordance with one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Referring to FIG. 1. FIG. 1 is a perspective view of a fan blade design in accordance with one embodiment of the present disclosure. As an example illustrated in FIG. 1, a fan blade design 1 is employed in a cooling fan.

In one embodiment, the fan blade design 1 includes a hub 10 and a plurality of blades 20. The embodiment includes five blades 20. However, the embodiment is not limited thereto. In other embodiments, different numbers of the blades can be employed depending on design requirements. In one embodiment, a motor 33 is disposed inside the hub 10, and is configured to drive the rotation of the hub 10 and the blades 20, thereby generating airflow for cooling or ventilation purposes.

In one embodiment, all of the blades 20 are structurally identical in shape and orientation, and each of the blades 20 is coupled to the hub in a generally radial configuration. For purpose of clarity and brevity, the following description will focus on a single representative blade 20 and its relationship to the hub 10.

Figure 2:
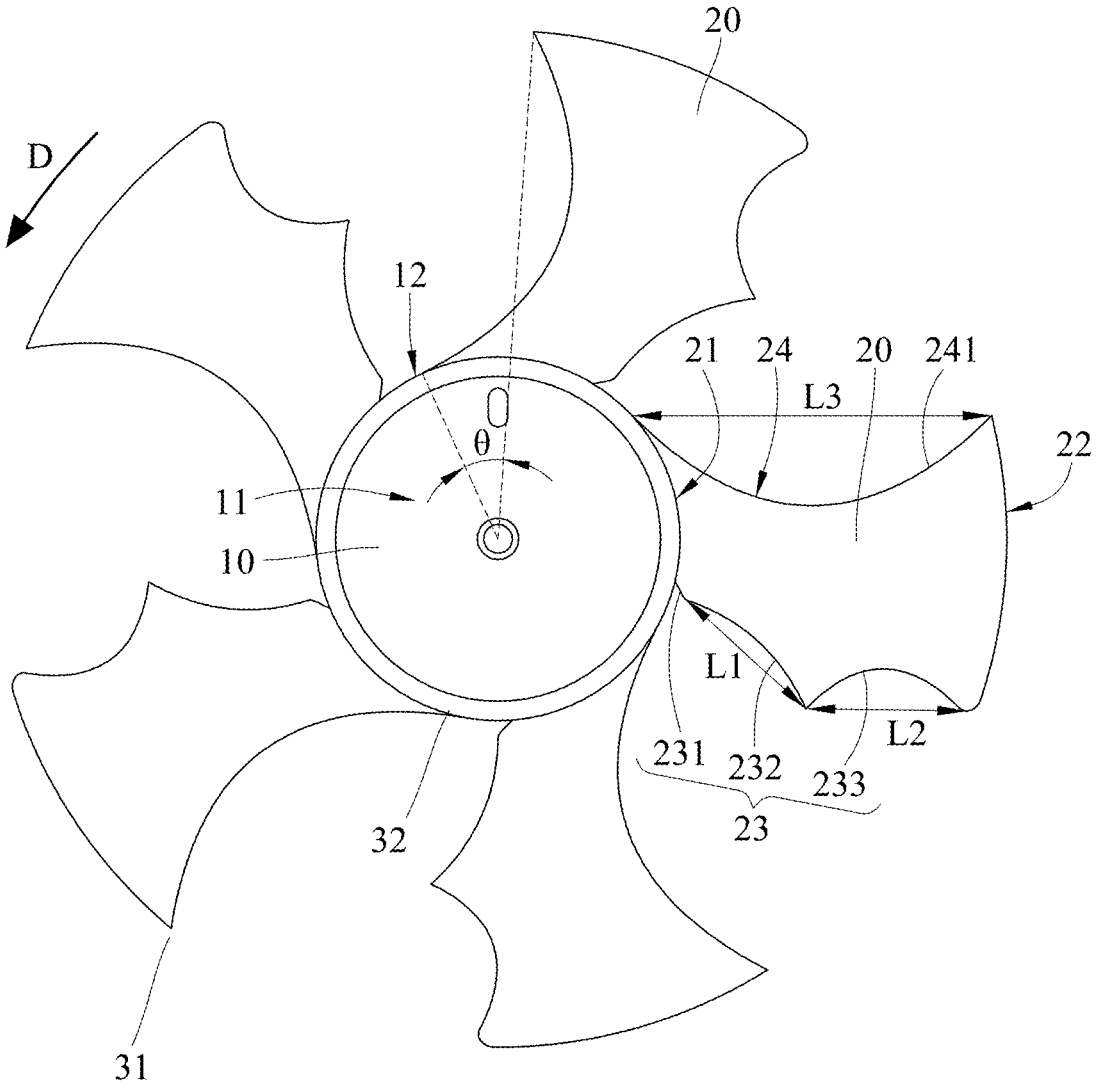
FIG. 2 is a front view of the fan blade design shown in FIG. 1.
Figure 3:
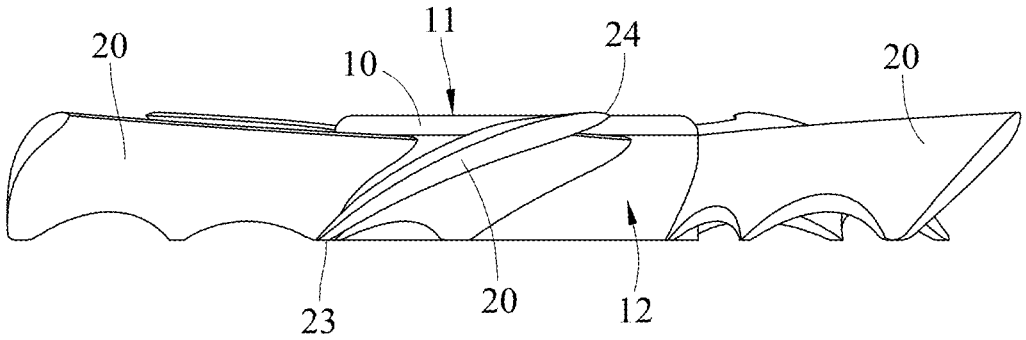
FIG. 3 is a side view of the fan blade design shown in FIG. 1.

Referring to FIGS. 2-3. FIG. 2 is a front view of the fan blade design shown in FIG. 1. FIG. 3 is a side view of the fan blade design shown in FIG. 1. As an example illustrated in FIGS. 2-3, the hub 10 includes a top surface 11 and an outer peripheral surface 12.

In one embodiment, the outer peripheral surface 12 extends circumferentially from the perimeter of the top surface 11. In an example, the blade 20 is configured as a swept-back blade. In the direction of rotation D of the fan blade design 1, the tip 31 of the blade 20 is positioned rearward relative to its root 32. The rearward displacement defines a sweepback angle θ between the tip 31 and the root 32 of the blade 20 from the center of the hub 10. In one embodiment, the sweepback angle θ is greater than 19 degrees. However, other angles may be employed depending on the specific design objectives.

As an example illustrated in FIGS. 2-3, the blade 20 includes an inner edge 21, an outer edge 22, a trailing edge 23, and a leading edge 24. In one embodiment, the inner edge 21 of the blade 20 is joined to the outer peripheral surface 12 of the hub 10, and the outer edge 22 is disposed opposite the inner edge 21. The trailing edge 23 and the leading edge 24 span between the inner edges 21 and the outer edges 22, thereby defining the overall aerodynamic profile of the blade 20. In one embodiment, the leading edge 24 is positioned closer to the top surface 11 of the hub 10 than the trailing edge 23, contributing to the blade's aerodynamic orientation and enhancing airflow performance.

In one embodiment, the trailing edge 23 of the blade 20 includes a straight segment 231, a first concave arc segment 232, and a second concave arc segment 233. The first concave segment 232 is seamlessly connected to the second concave segment 233, and the first concave arc segment 232 is disposed between the straight segment 231 and the second concave arc segment 233. The first concave arc segment 232 is connected to the outer peripheral surface 12 of the hub 10 via the straight segment 231 and is positioned closer to the hub 10 than the second concave arc segment 233.

In one embodiment, the chord length L1 of the first concave arc segment 232 is greater than the chord length L2 of the second concave arc segment 233. The ratio of chord lengths L1 to L2 is at least 1.1 to 1. Further, the radius of curvature of the first concave arc segment 232 is greater than that of the second concave arc segment 233. These dimensional relationships enhance blade geometry, influencing airflow properties.

In one embodiment, the leading edge 24 of the blade 20 further includes a third concave arc segment 241. The chord length L3 of the third concave arc segment 241 is greater than the combined chord lengths of the first concave arc segment 232 and the second concave arc segments 233 (i.e., L3>L1+L2), resulting in an extended aerodynamic surface at the side of the leading edge 24 of the blade 20.

By positioning the first concave arc segment 232 closer to the hub 10 than the second concave arc segment 233, and designing the chord length L1 to be greater than L2 with a ratio of at least 1.1 to 1, the fan with this blade design 1 can reduce operational noise compared to conventional fans. For example, the table below illustrates the rotational speeds at which a fan using the present blade design and a conventional fan (with a convex trailing edge) generate the same level of noise.

| | 41.6 dB | 33 dB | 25 dB |
|---|---|---|---|
| Fan using the blade design of the present disclosure | 3393 rpm | 2379 rpm | 1779 rpm |
| Fan using the conventional blade design | 3124 rpm | 2317 rpm | 1748 rpm |

As shown in the table above, when two fans generate the same level of noise, the fan incorporating the blade design 1 of the present disclosure operates at a higher rotational speed compared to a fan with a conventional blade design. In other words, when both fans rotate at the same speed, the fan with the present novel blade design generates less noise. The experimental data from the table demonstrates that the disclosed blade design can effectively reduce noise generation while maintaining operational speed.

Additionally, the fan with the blade design 1 of the present disclosure demonstrates superior airflow performance across various speed ranges in comparison to a fan with a conventional blade design. For example, at high rotational speeds between around 2,601 rpm (Revolutions Per Minute) and 3,500 rpm, the fan with the present blade design achieves a static pressure enhancement of around 15%. At medium speeds, ranging from around 2,001 rpm to 2,600 rpm, the static pressure improves by approximately 12.9%. At lower speeds, ranging from about 1,400 rpm to 2,000 rpm, the fan demonstrates a significant improvement in static pressure of approximately 37.5%. The results indicate that the present blade design enhances overall fan performance, particularly in low-speed scenarios where efficient cooling and noise reduction are critical.

Figure 4:
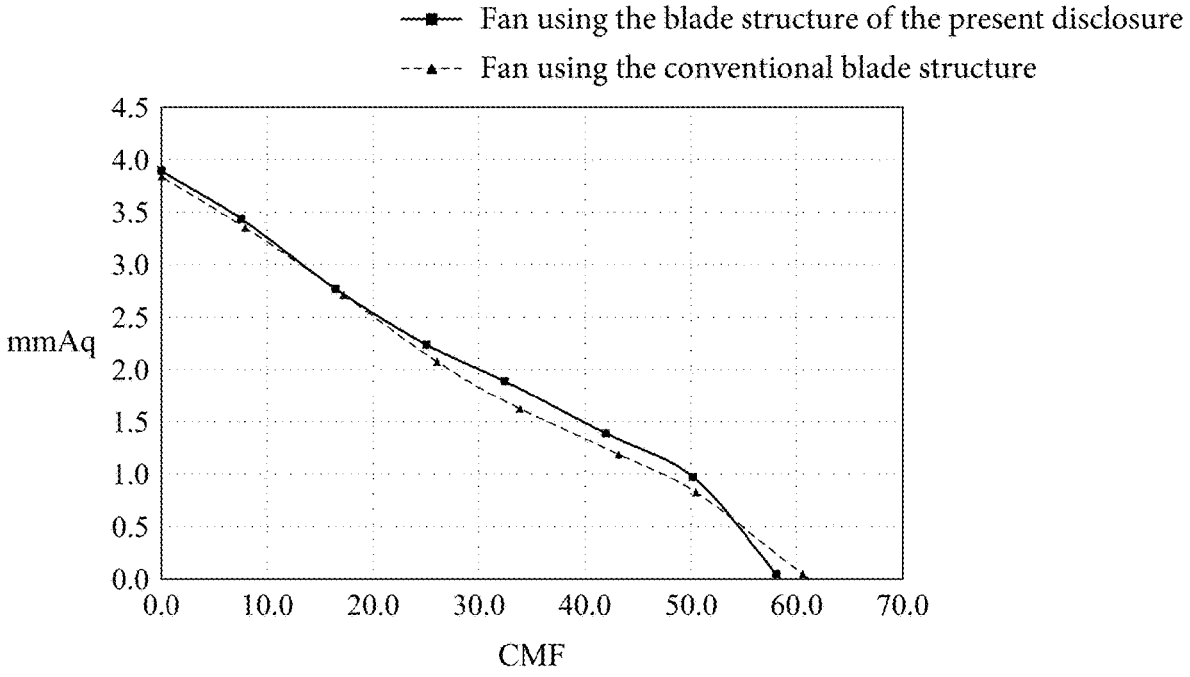
FIG. 4 is a graphical chart comparing performance characteristics of a fan incorporating the fan blade design of the present disclosure with those of a conventional fan at high rotational speeds.
Figure 5:
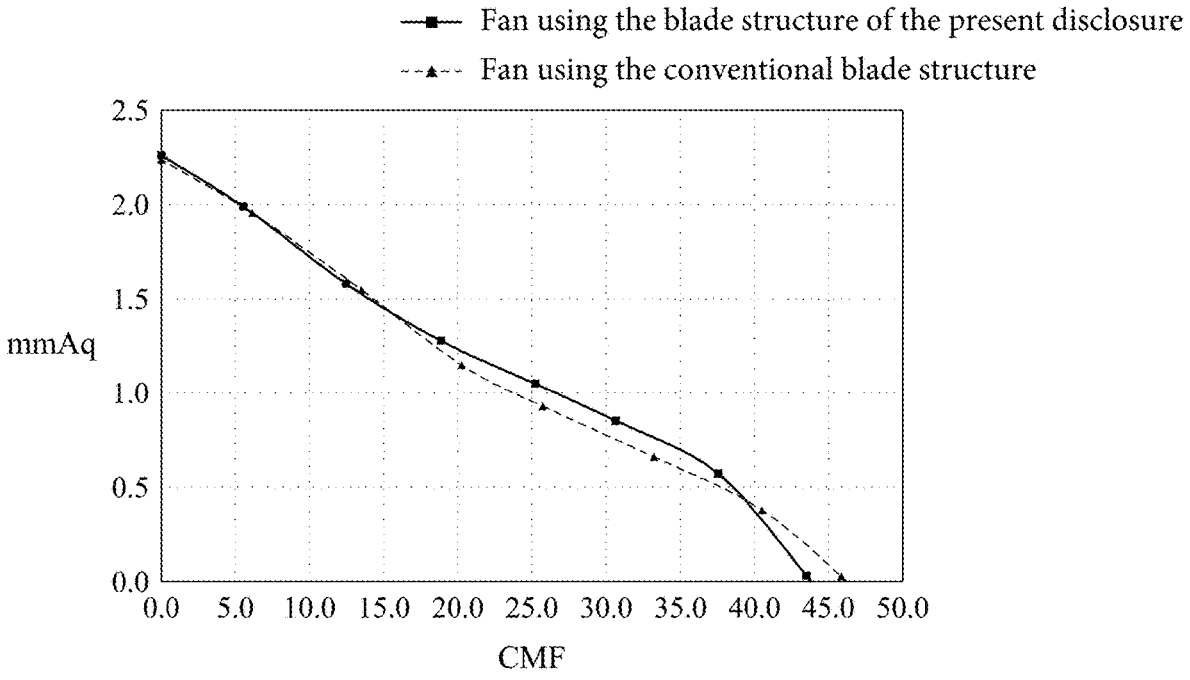
FIG. 5 is a graphical chart comparing performance characteristics of a fan incorporating the fan blade design of the present disclosure with those of a conventional fan at medium rotational speeds.

Referring to FIGS. 4-5. FIG. 4 is a graphical chart comparing performance characteristics of a fan with the fan blade design of the present disclosure with those of a conventional fan at high rotating speeds. FIG. 5 is a graphical chart comparing performance characteristics of a fan with the fan blade design of the present disclosure with those of a conventional fan at medium rotating speeds.

According to the experimental data illustrated in FIG. 4, when comparing a fan with the blade design of the present disclosure with a fan with a conventional blade design under high-speed operation, the fan with the present blade design demonstrates significantly higher static pressure within an airflow range of approximately 25 CFM (Cubic Feet per Minutes) to 53 CFM.

According to the experimental data illustrated in FIG. 5, under medium-speed operation, the fan with the present blade design demonstrates a considerably higher static pressure within an airflow range of approximately 18 CFM to 38 CFM, compared to the fan with the conventional blade design. The above results indicate a significant improvement in the fan's performance attributed to the blade design disclosed herein.

Further, because the blade design disclosed herein is swept-back blades, i.e., each having a sweepback angle θ greater than 19 degrees, the noise reduction effect of the fan is further enhanced. The rearward sweepback angle enhances aerodynamic, which reduces noise generation during fan operation.

In summary, the blade design of the present disclosure indicated above provides significant performance advantages. Specifically, the blades are configured as swept-back blades, featuring a trailing edge with a first concave arc segment positioned closer to the hub's outer peripheral surface than a second concave arc segment. The chord length of the first concave arc segment is greater than that of the second concave arc segment, with a ratio of at least 1.1 to 1. This geometric configuration reduces the noise generated during fan operation while maintaining the fan's overall performance. Additionally, the design characteristic of each blade having a sweepback angle greater than 19 degrees further enhances the noise-reduction effect of the fan blade design, leading to a quieter and more efficient cooling system.

Therefore, embodiments disclosed herein are well adapted to attain the ends and advantages mentioned as well as those that are inherent therein. The particular embodiments disclosed above are illustrative only, as the embodiments disclosed may be modified and practiced in different but equivalent manners apparent to those of ordinary skill in the relevant art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. Of course, the disclosed embodiments are merely exemplary embodiments and that various modifications can be made without departing from the spirit and scope of the disclosure. Further, it should be understood that various aspects of the embodiment are not mutually exclusive of each other and can be combined as desired by a person of ordinary skill in the art as a matter of design choices.

The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some number. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

What is claimed is:

1. A fan blade design, comprising:

a hub; and a plurality of blades connected to the hub, wherein each of the blades is a swept-back blade and has a leading edge and a trailing edge disposed opposite the leading edge, the trailing edge includes a first concave arc segment and a second concave arc segment, the first concave arc segment being positioned closer to the hub than the second concave arc segment, and a chord length of the first concave arc segment is greater than a chord length of the second concave arc segment.

2. The fan blade design of claim 1, wherein the first concave arc segment is seamlessly connected to the second concave arc segment.

3. The fan blade design of claim 1, wherein a ratio of the chord length of the first concave arc segment to the chord length of the second concave arc segment is at least 1.1.

4. The fan blade design of claim 1, wherein the trailing edge further comprises a straight segment that is located between the hub and the first concave arc segment.

5. The fan blade design of claim 4, wherein the first concave arc segment is connected to the hub via the straight segment.

6. The fan blade design of claim 1, wherein the hub has a top surface, and the leading edge of each blade is arranged closer to the top surface of the hub than the trailing edge of the blade.

7. The fan blade design of claim 6, wherein the leading edge of each blade includes a third concave arc segment, and a chord length of the third concave arc segment is greater than combined chord lengths of the first and second concave arc segment.

8. The fan blade design of claim 1, wherein the hub includes a top surface and an outer peripheral surface, the outer peripheral surface is connected to a periphery of the top surface, and the blades are connected to the outer peripheral surface of the hub.

9. The fan blade design of claim 1, wherein each blade extends radially outward and declines from the leading edge to the trailing edge.

10. The fan blade design of claim 1, wherein the blade has a tip and a root, the tip is positioned rearward relative to the root, and a sweepback angle between the tip and the root from a center of the hub is greater than 19 degrees.

11. A cooling fan, comprising:

a fan blade design, including:

a hub; and a plurality of blades connected to the hub, wherein each of the blades is a swept-back blade and has a leading edge and a trailing edge disposed opposite the leading edge, the trailing edge includes a first concave arc segment and a second concave arc segment, the first concave arc segment being positioned closer to the hub than the second concave arc segment, and a chord length of the first concave arc segment is greater than a chord length of the second concave arc segment; and a motor that is disposed inside the hub and is configured to drive a rotation of the hub and the blades.

12. The cooling fan of claim 11, wherein the first concave arc segment is seamlessly connected to the second concave arc segment.

13. The cooling fan of claim 11, wherein a ratio of the chord length of the first concave arc segment to the chord length of the second concave arc segment is at least 1.1 to 1.

14. The cooling fan of claim 11, wherein the trailing edge further comprises a straight segment that is located between the hub and the first concave arc segment.

15. The cooling fan of claim 14, wherein the first concave arc segment is connected to the hub via the straight segment.

16. The cooling fan of claim 11, wherein the hub has a top surface, and the leading edge of each blade is positioned closer to the top surface of the hub than the trailing edge.

17. The cooling fan of claim 16, wherein the leading edge of each blade includes a third concave arc segment, and a chord length of the third concave arc segment is greater than combined chord lengths of the first and second concave arc segment.

18. The cooling fan of claim 11, wherein the hub includes a top surface and an outer peripheral surface, the outer peripheral surface is connected to a periphery of the top surface, and the blades are connected to the outer peripheral surface of the hub.

19. The cooling fan of claim 11, wherein each blade extends radially outward and declines from the leading edge to the trailing edge.

20. The cooling fan of claim 11, wherein the blade has a tip and a root, the tip is positioned rearward relative to the root, and a sweepback angle between the tip and the root from a center of the hub is greater than 19 degrees.

* * * * *